United States Patent [19]

Schmid et al.

[11] Patent Number: 4,495,092

[45] Date of Patent: Jan. 22, 1985

[54] VISCOSITY REGULATORS FOR HIGH-VISCOSITY SURFACTANT CONCENTRATES

[75] Inventors: Karl H. Schmid, Mettman; Hans J. Rommerskirchen, Duesseldorf-Eller; Herbert Reuter, Hilden; Wolfgang Seiter, Neuss; Robert Piorr, Ratingen-Hoesel, all of Fed. Rep. of Germany

[73] Assignee: Henkel Kommanditgesellschaft auf Aktien, Duesseldorf, Fed. Rep. of Germany

[21] Appl. No.: 577,433

[22] Filed: Feb. 6, 1984

[30] Foreign Application Priority Data

Feb. 17, 1983 [DE] Fed. Rep. of Germany ..... 3305430

[51] Int. Cl.[3] ..... C11D 1/825

[52] U.S. Cl. ..... 252/559; 252/174.21; 252/538; 252/540; 252/557; 252/DIG. 1; 252/DIG. 4

[58] Field of Search ..... 252/557, 538, 174.21, 252/540, 559, DIG. 1, DIG. 4

[56] References Cited

U.S. PATENT DOCUMENTS

| | | | |
|---|---|---|---|
| 3,274,117 | 9/1966 | Stein et al. | 252/557 |
| 3,393,213 | 7/1968 | Kiefer et al. | 252/557 |
| 3,413,221 | 11/1968 | Gotte et al. | 252/557 |
| 3,954,643 | 5/1976 | Krings et al. | 252/557 |

FOREIGN PATENT DOCUMENTS

| | | |
|---|---|---|
| 0024711 | 3/1981 | European Pat. Off. . |
| 2326006 | 12/1973 | Fed. Rep. of Germany . |

*Primary Examiner*—Paul Lieberman
*Assistant Examiner*—Hoa Van Le
*Attorney, Agent, or Firm*—Ernest G. Szoke; Henry E. Millson, Jr.; Mark A. Greenfield

[57] ABSTRACT

$C_8$–$C_{40}$ Alcohols, or $C_8$–$C_{40}$ alcohol containing one or more hydroxyl groups and onto which up to 20 moles of ethylene oxide and/or propylene oxide can be added per mole of alcohol, when added to aqueous industrial anionic surfactant concentrates, particularly concentrates of α-sulfofatty acid esters containing at least 50% by weight of the sodium salt of α-sulfofatty acid ester, significantly improve the rheological behavior thereof. The alcohols are added in quantities of from about 1 to about 15% by weight, based on the quantity of surfactant, whereupon the viscosity of the surfactant concentrate becomes at most 10,000 mPas at 70° C.

21 Claims, No Drawings

VISCOSITY REGULATORS FOR HIGH-VISCOSITY SURFACTANT CONCENTRATES

BACKGROUND OF THE INVENTION

The production of powder-form or granular detergents and cleaners on an industrial scale by the hot spray-drying process starts out from aqueous suspensions or slurries which contain a large part of or even all the detergent ingredients. For economic reasons, it is important that the slurry should contain as many of the detergent ingredients as possible, i.e. should be substantially free from liquid ballast. Accordingly, as little water as possible is used in making up the slurries. However, the degree of concentration is limited by the highest possible viscosity at which the slurry can still just be processed. An important ingredient of most detergents and cleaners are anionic surfactants which are generally used as paste-like concentrates in the form of their alkali or ammonium salts in the production of the detergent slurry. In the case of α-sulfotallow fatty acid methyl ester for example, the surfactant content of commercial concentrates amounts to around 30% by weight. Pastes having a higher surfactant content cannot be processed.

One feature of the rheological behavior of surfactant concentrates is that they react to the addition of water not by a reduction in viscosity, but rather by an initial increase in viscosity to a gel-like state, giving rise to further problems for the processor. For example, gel lumps that have formed are often not easy to redissolve or, alternatively, valves of pumps and vessels become blocked.

Various proposals have been made with a view to solving these problems. German Application No. 22 51 405 for example describes the salts of certain carboxylic acids, particularly hydroxy carboxylic acids, as viscosity regulators. According to German Application No. 23 05 554, sulfonated aromatic compounds are suitable for this purpose. German Application No. 23 26 006 discloses sulfates or sulfonates of aliphatic, optionally substituted hydrocarbons as viscosity regulators. Publications also disclose the addition of lower alkanols as a possible method of reducing viscosity. The addition of the well-known hydrotropes, such as cumene sulfonate for example, or of acidic phosphoric acid esters (German Application No. 16 17 160) or of polyhydric alcohols, certain carboxylic acids and/or esters of these compounds (German Application No. 8 060) has also been described. It is known from European Application No. 24 711 that the rheological behavior of anionic surfactant concentrates can be improved by adding sulfates of certain polyalkyl ether glycols. It is known from German Patent No. 14 18 887 that an excess of $SO_3$ remaining in the crude sulfonic acid after the sulfonation of fatty acids or their esters can be removed by reacting the excess $SO_3$ with stoichiometric or greater than stoichiometric quantities of compounds that react readily with $SO_3$ to form capillary-active substances, including aliphatic alcohols and adducts of ethylene oxide and/or propylene oxide with aliphatic alcohols. However, there is no indication in this Patent Specification of how to reduce the viscosity of the surfactant concentrate with a sulfonation product containing very little, if any, $SO_3$.

Some of the additives mentioned in the literature do not work in every surfactant concentrate, some have to be used in high concentrations while others, such as lower alkanols, reduce the flash point of the concentrates.

DESCRIPTION OF THE INVENTION

Accordingly, the object of the present invention is to provide substances for improving the rheological behavior of aqueous, industrial anionic surfactant concentrates so that they can be processed in higher concentrations than before and do not undergo any increase in viscosity on dilution with water. Viscosity regulation is a particular problem for concentrates of α-sulfofatty acid esters because concentrates having a surfactant content of more than only about 30% by weight cannot be processed without difficulty. In the absence of the viscosity problem, it would be technically possible to produce surfactant concentrates having a surfactant content of up to about 80% by weight. Accordingly, reducing the viscosity of α-sulfofatty acid ester concentrates is a particular object of the present invention.

According to the invention, the objects as stated above are achieved by using alcohols containing from 8 to 40 carbon atoms which can additionally contain one or more hydroxyl groups as substituents and onto which up to 20 moles of ethylene oxide and/or propylene oxide can be added per mole of alcohol, as viscosity regulators for high-viscosity industrial surfactant concentrates of the synthetic anionic surfactant type, particularly α-sulfofatty acid esters containing at least 50% by weight of the sodium salt of α-sulfofatty acid esters, the viscosity regulator being added in quantities of from about 1 to about 15% by weight, based on the quantity of surfactant, to the sulfonation product freed completely or substantially completely from excess sulfonating agent, as a result of which the viscosity of the surfactant concentrate is adjusted to at most 10,000 mPas at 70° C. In other words, the viscosity of the concentrates at the particular processing temperature, i.e. at the temperature at which the surfactant concentrates are produced, pumped, mixed with other detergent ingredients or sprayed (operations which are generally carried out at temperatures in the range from about 60° to about 90° C., for example at about 70° C.) can be reduced to a viscosity suitable for processing of at most 10,000 mPas (Hoppler dropped-ball viscosimeter).

Another very significant advantage of the present invention lies in the fact that, in the commercial production of the surfactant concentrates, the surfactant content can be adjusted to values of at least about 50% by weight without having the viscosity exceed the permitted upper limit for processibility of approximately 10,000 mPas, so that surfactant concentrates containing relatively little water as ballast are obtained. Finally, most of the viscosity-regulating compounds described in more detail hereinafter show capillary active properties which, in cases where the surfactant concentrates are used in detergents, bring about an increase in the detergent power of the detergents.

Alcohols suitable for use as viscosity regulators are aliphatic alcohols or alkyl-substituted phenols containing from 8 to 40 carbon atoms, and adducts thereof with from 1 to 20 moles of ethylene oxide and/or propylene oxide. The aliphatic alcohols are derived, for example, from natural fats and oils. These so-called fatty alcohols have straight chains and may be saturated or unsaturated. Particularly effective and therefore preferred viscosity regulators are mixtures of saturated and unsaturated fatty alcohols onto which from 1 to 8 moles of ethylene oxide and/or propylene oxide can be added. Examples of such fatty alcohol mixtures are cetyl/oleyl alcohol mixtures of which at least 80% by weight consist of $C_{16}$–$C_{18}$ fatty alcohols and which have an iodine number of from 40 to 100. If first 1 mole of propylene oxide and then 6 moles of ethylene oxide are added onto a mixture such as this per mole of alcohol, an extremely effective viscosity regulator is obtained. However, aliphatic alcohols or adducts suitable for use as viscosity regulators can also have a branched carbon chain in the alcohol component. Examples of alcohols having a branched carbon chain are oxoalcohols and Guerbet alcohols, i.e. alcohols branched in the 2-position obtained by oxo synthesis or by the so-called Guerbet reaction. As the result of an intermolecular condensation of alcohol at temperatures above 200° C. in the presence of sodium or copper, the Guerbet reaction gives branched alcohols of which the side chain is shorter by 4 carbon atoms than their main chain. Alcohols having a branched carbon chain onto which up to 15 moles of ethylene oxide and/or propylene oxide have been added are particularly effective. Typical representatives of compounds such as these are a $C_{14-C15}$ -oxoalcohol mixture, onto which 7 moles of ethylene oxide have been added, and the 2-octyl dodecanol obtained by Guerbet's reaction onto which 15 moles of ethylene oxide have been added. Other extremely effective and therefore preferred viscosity regulators are derived from aliphatic alcohols containing a total of from 2 to 6 hydroxyl groups, optionally substituted with from 10 to 15 moles of ethylene oxide. Typical representatives of alcohols such as these are 12-hydroxy stearyl alcohol, which is derived from castor oil, and 9,10-dihydroxy stearyl alcohol which is derived from oleic acid. The addition compounds of 10 moles of ethylene oxide with 12-hydroxy stearyl alcohol and of 15 moles of ethylene oxide with 9,10-dihydroxy stearyl alcohol are also extremely effective and therefore preferred representatives of this class of compounds. Alkyl-substituted phenols suitable for use as viscosity regulators preferably contain from 6 to 15 carbon atoms in the alkyl chain. Typical representatives are nonyl phenol and iso-octyl phenol and the adducts of from 5 to 9 moles of ethylene oxide with such alkyl phenols.

The above-mentioned viscosity regulators are added to the anionic surfactant concentrates, for example to the alkyl sulfates, i.e. the alkali or ammonium salts of sulfuric acid esters of aliphatic $C_8$–$C_{14}$ -alcohols, or to the alkyl aryl sulfonates, i.e. sulfonation products of predominantly $C_4$–$C_{16}$ -alkyl benzene, and in particular to the α-sulfofatty acid ester concentrates, preferably in quantities of from about 5 to about 12% by weight, more preferably about 10% by weight, based on the quantity of surfactant; the required reduction in viscosity being determined by the quantity in which the viscosity regulator is added. In this connection, it is possible to produce the surfactant concentrate from anionic surfactant powder, i.e. in particular α-sulfofatty acid ester powder, and water in the presence of the viscosity regulator. However, the following procedure is of greater practical significance: fatty acid ester is sulfonated with gaseous, excess $SO_3$, generally diluted with an inert gas, and then all or most, i.e. up to at most 10 mole percent, of the excess, free $SO_3$ is removed after sulfonation, for example by separation. The viscosity regulator is added next, and the crude sulfonic acid is neutralized with concentrated aqueous alkali metal hydroxide solution, which results in the formation of a surfactant concentrate having a surfactant content of, for example, 50% by weight and a viscosity of less than 10,000 mPas at 70° C. If required, this concentrate can be bleached. If from about 0.5 to about 5% by weight, based on the neutralized sulfonation product, of water-soluble alkali or alkaline-earth metal salts, particularly alkali metal chloride, preferably sodium chloride, is also added together with the viscosity regulator, the viscosity-reducing effect of the viscosity regulator is distinctly intensified in most cases. Accordingly, the addition of sodium chloride is preferred. If the neutralized sulfonation product already contains water-soluble alkaline-earth or alkali metal salts in the above-mentioned concentration, for example from a preceding bleaching treatment with hypochlorite salt solution, there is no need for effect-boosting salts to be added.

The α-sulfofatty acid esters, to the concentrates of which the above-mentioned viscosity regulators are added, are derived from fatty acids containing from 10 to 20 and preferably from 12 to 18 carbon atoms and from aliphatic alcohols containing from 1 to 10 and preferably from 1 to 4 carbon atoms in the molecule. The sulfo group therein can be introduced not only by sulfonating a corresponding fatty acid ester, but also by sulfonating the fatty acid and subsequently esterifying the carboxyl group with alcohol. Both processes give sulfofatty acid esters in which the sulfo group is in the α-position. Particularly suitable α-sulfofatty acid esters are the alkali or ammonium salts of the ethyl ester and, more particularly, the methyl ester of tallow fatty acid containing a sulfo group in the α-position; the acid component of the fatty acid esters consisting essentially of saturated $C_{16}$–$C_{18}$ -fatty acids.

The invention will be illustrated by the following examples which are given for that purpose only and not for purposes of limitation.

EXAMPLES

EXAMPLES 1 to 5

Powder-form sodium salt of α-sulfotallow fatty acid methyl ester based on hydrogenated tallow fatty acid, which had been obtained by carefully concentrating an industrial aqueous concentrate by evaporation and which contained approximately 5% by weight of the disodium salt ("di-salt"), was mixed with water to form a 50% by weight paste. The paste thus formed had a viscosity of more than 50,000 mPas at 70° C. (Hoppler viscosimeter). When 10% by weight, based on solids, of the viscosity regulators used in accordance with the invention are added to portions of this paste, products having the viscosities indicated in Table 1 below are obtained.

TABLE 1

| No. | Viscosity regulator (10% by weight) | Viscosity at 70° C. in mPas |
|---|---|---|
| 1 | none | >50,000 |
| 2 | cetyl/oleyl alcohol mixture, iodine number 53 | 220 |
| 3 | cetyl/oleyl alcohol mixture, iodine number 53, + 5 moles of ethylene oxide | 1,490 |
| 4 | cetyl/oleyl alcohol mixture, iodine number 53, + 7.2 moles of ethylene oxide | 1,900 |
| 5 | cetyl/oleyl alcohol mixture, iodine number 53, + 8 moles of | 4,000 |

TABLE 1-continued

| No. | Viscosity regulator (10% by weight) | Viscosity at 70° C. in mPas |
|---|---|---|
| | ethylene oxide | |

The viscosities shown in Table 1 demonstrate the drastic reduction in viscosity obtained by using a mixture of saturated and unsaturated fatty alcohol (Example 2) and ethoxylates thereof with up to about 8 moles of added ethylene oxide (Examples 3 to 5).

EXAMPLES 6 to 10

A powder-form of the sodium salt of α-sulfotallow fatty acid methyl ester based on hydrogenated tallow fatty acid which contained approximately 2% by weight of sodium chloride and 20% by weight of "disalt" and which had been bleached with sodium hypochlorite was mixed with water to form an approximately 50% by weight paste. The viscosity of the paste obtained measured 50,000 mPas (70° C.). When 10% by weight, based on solids, of alcohol ethoxylates having a branched carbon chain in the alcohol component were added to portions of the above paste, products having the viscosities shown in Table 2 below were obtained. Table 2 also shows the viscosity of a product based on the same α-sulfofatty acid ester which contained as a viscosity regulator partly unsaturated alcohols onto which first 1 mole of propylene oxide and then 6 moles of ethylene oxide had been added per mole of alcohol mixture (Example 9). In addition, Table 2 shows the viscosity of a product containing as the viscosity regulator partly unsaturated alcohols onto which ethylene oxide had been added (Example 10).

TABLE 2

| No. | Viscosity regulator (10% by weight) | Viscosity at 70° C. in mPas |
|---|---|---|
| 6 | none | 50,000 |
| 7 | $C_{14}$–$C_{15}$ —oxoalcohol + 7 moles of ethylene oxide | 340 |
| 8 | 2-octyl dodecanol + 15 moles of ethylene oxide | 590 |
| 9 | cetyl/oleyl alcohol mixture, iodine number 53, + 1 mole of propylene oxide + 6 moles of ethylene oxide | 370 |
| 10 | tallow fatty alcohol + 5 moles of ethylene oxide | 1,210 |

Examples 7 and 8 illustrate the outstanding effectiveness of alcohol ethoxylates having a branched carbon chain in the alcohol component. Example 9 shows the effectiveness of partly unsaturated alcohols, onto which up to 8 moles of ethylene oxide/propylene oxide have been added, and Example 10 the effectiveness of a partly unsaturated fatty alcohol ethoxylate, in each case in combination with 2% by weight of sodium chloride.

EXAMPLES 11 to 13

The following Examples demonstrate the respective effects of an alkane diol and an alkane triol onto which ethylene oxide has been added. The concentrate of Examples 6 to 10 was used as the surfactant concentrate. Table 3 shows the viscosities of the products.

TABLE 3

| No. | Viscosity regulator (10% by weight) | Viscosity at 70° C. in mPas |
|---|---|---|
| 11 | none | 50,000 |
| 12 | 12-hydroxystearyl alcohol + 10 moles | 227 |

TABLE 3-continued

| No. | Viscosity regulator (10% by weight) | Viscosity at 70° C. in mPas |
|---|---|---|
| | of ethylene oxide | |
| 13 | 9,10-dihydroxystearyl alcohol + 15 moles of ethylene oxide | 340 |

EXAMPLE 14

When the above viscosity regulators were used in a fully continuous industrial process in which dilute $SO_3$ in excess was allowed to act on tallow fatty acid methyl ester at elevated temperature and the crude sulfonic acid, substantially free from $SO_3$, was bleached and subsequently neutrilized with concentrated aqueous sodium hydroxide solution in the presence of 10% by weight of the viscosity regulator, results comparable with those of Examples 1 to 5 were obtained.

EXAMPLE 15

The procedure was the same as that of Example 14, except that 2% by weight of sodium chloride in the form of a concentrated aqueous solution was added together with the sodium hydroxide solution and the viscosity regulator. The results obtained were comparable with those of Examples 6 to 10, i.e. even in the continuous production of approximately 50% by weight α-sulfofatty acid methyl ester cconcentrates, the addition of small quantities of sodium chloride intensifies the effect of the viscosity regulators of the invention.

What is claimed is:

1. A process for the preparation of an aqueous concentrate of an α-sulfofatty acid ester comprising the steps of:

(a) Sulfonating a fatty acid ester in the α-position with an excess of gaseous $SO_3$ to produce an α-sulfofatty acid ester;

(b) removing most or all of the excess $SO_3$ from the α-sulfofatty acid ester;

(c) adding to the α-sulfofatty acid ester (i) a monohydric or polyhydric alcohol containing from 8 to 40 carbon atoms or (ii) a reaction product a monohydric or polyhydric alcohol containing from 8 to 40 carbon atoms of with from 1 to 20 moles of ethylene oxide, propylene oxide, or a mixture of ethylene oxide and propylene oxide, per mole of alcohol;

(d) neutralizing the α-sulfofatty acid ester with concentrated aqueous alkali metal hydroxide solution wherein said solution is at a concentration sufficient to produce an α-sulfofatty acid ester concentration of at least 50% by weight;

and wherein the alcohol in step (c) is added in quantity sufficient to produce a viscosity of the aqueous concentrate of less than 10,000 mPas at 70° C.

2. A process in accordance with claim 1 wherein the quantity of alcohol in step (c) is from about 1 to about 15% by weight, based on the weight of the α-sulfofatty acid ester.

3. A process in accordance with claim 2 wherein the quantity of alcohol in step (c) is from about 5 to about 12% by weight.

4. A process in accordance with claim 1 wherein the alcohol in step (c) is a mixture of saturated and unsaturated fatty alcohols.

5. A process in accordance with claim 4 wherein the alcohol in step (c) is a reaction product with from 1 to 8 moles of ethylene oxide, propylene oxide, or a mixture thereof.

6. A process in accordance with claim 5 wherein the mixture of saturated and unsaturated fatty alcohols is at least 80% by weight $C_{16}$–$C_{18}$ fatty alcohols and is a reaction product with about 1 mole of propylene oxide and about 6 moles of ethylene oxide.

7. A process in accordance with claim 1 wherein the alcohol in step (c) contains a branched carbon chain.

8. A process in accordance with claim 7 wherein the alcohol in step (c) is a reaction product with from 1 to 15 moles of ethylene oxide, propylene oxide, or a mixture thereof.

9. A process in accordance with claim 1 wherein the alcohol in step (c) contains a total of from 2 to 6 hydroxyl groups.

10. A process in accordance with claim 9 wherein the alcohol in step (c) is a reaction product with from 10 to 15 moles of ethylene oxide.

11. A composition in concentrated aqueous form comprising at least 50% by weight of an α-sulfofatty acid ester surfactant and (i) a monohydric or polyhydric alcohol containing from 8 to 40 carbon atoms or (ii) a reaction product of a monohydric or polyhydric alcohol containing from 8 to 40 carbon atoms. with from 1 to 20 moles of ethylene oxide, propylene oxide, or a mixture of ethylene oxide and propylene oxide, per mole of alcohol; said alcohol being present in an amount sufficient to reduce the viscosity of the surfactant concentrate to no more than 10,000 mPas at 70° C.

12. A composition in accordance with claim 11 wherein the viscosity reducing quantity of alcohol is from about 1 to about 15% by weight, based on the weight of surfactant.

13. A composition in accordance with claim 11 wherein the viscosity reducing quantity of alcohol is from about 5 to about 12% by weight.

14. A composition in accordance with claim 11 wherein the alcohol is a mixture of saturated and unsaturated fatty alcohols.

15. A composition in accordance with claim 14 wherein said alcohol is a reaction product with from 1 to 8 moles of ethylene oxide, propylene oxide, or a mixture thereof.

16. A composition in accordance with claim 14 wherein the mixture of saturated and unsaturated fatty alcohols is at least 80% by weight $C_{16}$–$C_{18}$ fatty alcohols and is a reaction product with about 1 mole of propylene oxide and about 6 moles of ethylene oxide.

17. A composition in accordance with claim 11 wherein the alcohol contains a branched carbon chain.

18. A composition in accordance with claim 17 wherein the alcohol is a reaction product with from 1 to 15 moles of ethylene oxide, propylene oxide, or a mixture thereof.

19. A composition in accordance with claim 11 wherein the alcohol contains a total of from 2 to 6 hydroxyl groups.

20. A composition in accordance with claim 11 wherein the alcohol is a reaction product with from 10 to 15 moles of ethylene oxide.

21. A composition in accordance with claim 11 which also contains from about 0.5 to about 5% by weight, based on the weight of surfactant, of a water soluble alkali or alkaline earth metal inorganic salt.

* * * * *